United States Patent [19]

Meredith

[11] Patent Number: 4,675,879

[45] Date of Patent: Jun. 23, 1987

[54] INDUCTION FURNACES

[75] Inventor: Jeffrey F. Meredith, Sandy Point, Australia

[73] Assignee: Foseco Trading A.G., Chur, Switzerland

[21] Appl. No.: 714,444

[22] Filed: Mar. 21, 1985

[30] Foreign Application Priority Data

Apr. 7, 1984 [GB] United Kingdom ..... 8409063

[51] Int. Cl.[4] ..... F27D 1/10

[52] U.S. Cl. ..... 373/155

[58] Field of Search ..... 373/151–158, 373/75; 266/280, 284, 286

[56] References Cited

U.S. PATENT DOCUMENTS 3,401,226 9/1968 Renkey ..... 373/155
3,401,227 9/1968 Dunlevy et al. ..... 373/155
3,751,571 8/1973 Burrows ..... 373/155
3,916,047 10/1975 Niesen ..... 373/155

FOREIGN PATENT DOCUMENTS 1312150 4/1973 United Kingdom .
2121150 12/1983 United Kingdom .

*Primary Examiner*—Roy N. Envall, Jr.
*Attorney, Agent, or Firm*—Nixon & Vanderhye

[57] ABSTRACT

An induction furnace has an inner discardable lining formed from one or more preformed shapes of refractory, heat-insulating material. The discardable lining is easily replaceable using a minimum of time and effort. The lining provides more efficient furnace operation, as less electrical energy is consumed and less time is required to melt down the solid metallic charge. In addition the molten metal is cleaner i.e. it contains fewer deleterious inclusions compared with a conventional refractory, inner lining.

18 Claims, 1 Drawing Figure

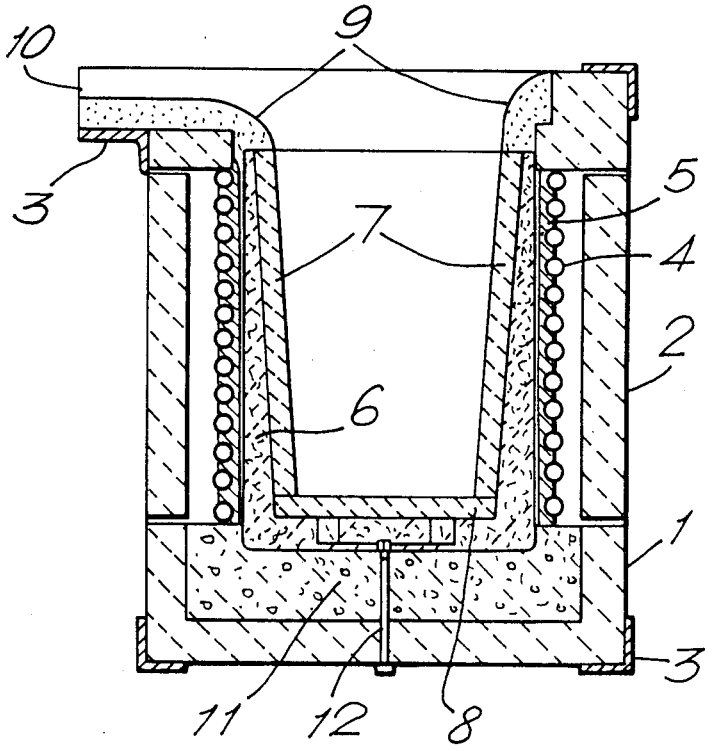
10
9
3
5
7
4
2
6
1
3
11
12
8

INDUCTION FURNACES

This invention relates to induction furnaces for use in metal casting.

It is known that particularly severe operating conditions exist within the melting zone of an induction furnace, wherein a phase change occurs upon the initial solid metallic charge, introduced into the melting zone, as it changes from its solid state into a liquid state. This phase change occurs at very high temperatures e.g. upto about 1700° C. or more. Accordingly, it has been customary to use a high density, highly refractory material to form a permanent, inner lining.

Surprisingly, we have now found that it is possible to use relatively less durable refractory materials as the inner lining of an induction furnace such as those proposed for use as the inner linings in foundry ladles where far less arduous operating conditions prevail.

Our European Pat. No. 0043670-B describes a foundry ladle having an inner discardable lining made of refractory material which has relatively high heat-insulation and relatively low heat-conductivity.

According to the present invention an induction furnace is provided with an inner, discardable lining which comprises one or more preformed shapes of refractory, heat-insulating material.

The discardable lining may be in the form of a self-supporting preformed unitary lining or formed from a plurality of abutting or interfitting slabs or other shaped articles.

The refractory, heat-insulating material used is capable of retarding the rate of heat loss from the molten metal held in the furnace and also capable of withstanding the high temperatures associated with melting metals e.g. ferrous metals such as iron or steel.

In addition the lining is able to withstand the physical effects of thermal cycling, between ambient and temperatures of about 1700° C., for a sufficient duration of time to enable a plurality of separate heats to be melted before the inner discardable lining needs to be replaced. Furthermore, the lining is relatively robust in that it resists fracture during charging of the furnace with solid bars, billets, ingots or scrap metal.

As mentioned above the innermost lining of an induction furnace is generally formed from a permanent refractory lining e.g. a mortared refractory brick lining or a cast monolithic refractory lining. These linings are not discardable in the sense that their initial high material and installation costs demands prolonged use before they can be considered due for replacement. Similarly, much time consuming and manual effort is involved when repacing a permanent lining.

Each linings are not particularly heat-insulating and consequently more electrical energy is consumed by the induction furnace than otherwise would be the case when a refractory, heat-insulating material of the invention is used. Furthermore, the necessity to achieve prolonged use requires a furnace operator to expend much time and effort in cleaning and preparing a furnace for melting different specification metals or alloys whereas a lining according to the present invention can be discarded and easily and quickly replaced whenever operating conditions indicate that such replacement is favourable.

In addition a lining according to this invention offers a particular advantage in that the melting time, for e.g. a ferrous metal charge, can be accomplished more quickly than is possible in the case of a conventional permanent refractory lining, thereby saving considerable amounts of energy.

In this connection savings of from about 10% upto about 30% may be readily attained.

It will be appreciated that an inner discardable lining of the present invention acts as the containment part of the induction furnace assembly for the molten metal and thus provides the necessary barrier between the melt and the electro-magnetic induction coils of the furnace. The thickness of the linings may be from about 15 to 50 mm, in the case of a plurality of slabs the sidewall linings may be about 20 to 40 mm preferably 25 mm and the base board 25 to 50 mm preferably 40 mm.

Alternatively, the inner discardable lining may be a unitary arcuate lining having an integral floor portion. However, the arcuate lining may comprise a plurality of separate arcuate portions superimposed one upon another. The floor portion of the latter arrangement may be separate or, integrally formed in one of the arcuate portions, which in use is placed against the induction furnace floor.

Optionally, a secondary lining may be provided between the induction coil and the inner discardable lining. The secondary lining may be a further preformed unitary lining or a plurality of lining slabs as described with respect to the innermost lining. However, as the secondary lining is not contacted by the molten metal the material used as the secondary lining may be less refractory and more highly heat-insulating than the inner lining. The inner and secondary linings may be intimately laminated together i.e. formed as a duplex lining.

Alternatively, the secondary lining may be in the form of a layer of unbonded particulate refractory material such as chromite, silica, alumina, magnesia, olivine or aluminosilicates e.g. crushed firebrick grog. The particulate layer may be provided before or after the inner lining has been placed into the induction furnace. If desired the particulate layer may be bonded with a low temperature binder such as a silicate or phosphate binder e.g. a sodium silicate or an aluminium-orthophosphate.

In the event that the inner lining is formed from a plurality of abutting or interfitting slabs the joints between adjacent slabs may be sealed with a refractory sealant material.

A means of detecting when the inner discardable lining is due for replacement may be provided in the form of an electrical earth leak detection circuit having detector means located within or behind the inner lining but in front of the induction coil. The detector may comprise earth leak detection paper, metal foil or rods.

The inner discardable lining may be formed from a variety of compositions. In general the discardable lining of this invention may be formed of fibrous materials, particulate refractory fillers and binders. Preferred organic fibrous materials are paper fibres such as repulped newsprint or synthetic fibres such as rayon or polyester fibre. Preferred inorganic fibrous materials are slag wool, mineral wool, calcium silicate fibre, aluminosilicate fibre and glass fibre. Preferred particulate refractory fillers are silica, alumina, magnesia, refractory silicates, e.g. grog, zircon and olivine. Preferred binders include both inorganic and organic binders such as colloidal silica sol, sodium silicate, starch, phenol-formaldehyde resin or urea-formaldehyde resin.

A particularly preferred range of proportions of the compositions of the inner discardable linings are as follows:

refractory filler 80–95% by weight
inorganic fibre upto 5% by weight
organic fibre upto 5% by weight
inorganic binder upto 4% by weight
organic binder upto 7% by weight.

After drying and curing, slurry-formed linings according to this invention, preferably have a density from 1.1 to 1.8 $g.cm^{-3}$ and a transverse strength of more than 20 $kg.cm^{-2}$.

After a plurality of heats have been melted in an induction furnace lined in accordance with the invention, the inner lining is inspected and, if damaged, it can be easily removed without disturbing any of the permanent portions of the furnace. A new inner lining may be inserted quickly and easily and the furnace returned to service in a minimum of down-time.

The invention is illustrated with reference to the accompanying drawing which represents a partially sectioned side elevation of an induction furnace:

An induction furnace has an outer casing 1 comprising one or more removable panels 2 made of refractory ceramic material e.g. asbestos-cement held by a metal framework 3. A water-cooled induction coil 4 is contained within a monolithic refractory cement layer 5 adjacent to and on the interior of which there is provided a secondary lining 6 of crushed firebrick material and an inner lining consisting of a plurality of preformed refractory, heat-insulating sidewall slabs 7 and a base board 8 formed from a composition comprising:

| Ingredient | % |
|---|---|
| magnesite | 82.00 |
| silica flour | 11.00 |
| inorganic fiber | 3.00 |
| boric acid | 2.00 |
| phenol-formaldehyde resin | 2.00 |

The density of subsequently dried and cured aqueous slurry-formed slabs was 1.63 $g.cm^{-3}$ and possessed a tensile strength of 30 $kg.cm^{-2}$.

The upper portions of linings 6 and 7 are capped with sodium silicate bonded sand 9. The part of the capping 10 is profiled to provide a pouring channel. The base of the induction furnace is shown with a cast refractory aggregate lining 11 and an earth leakage detector device 12.

The induction furnace was used to melt ductile iron from ambient to 1500° C. for 30 heats before it was found necessary to replace the inner discardable lining. This is a most satisfactory performance since the inner lining was the subject of repeated charging, heating and cooling so that the detrimental effects of thermal cycling and physical abrasion were severe.

It was observed that the melting time for each heat was reduced from 120 minutes in the case where the induction furnace was previously lined with permanent, refractory silica brick lining to 100 minutes when the same furnace was lined in accordance with the invention. The reduction in melting time of approximately 16% represents a considerable saving in energy requirements and costs compared with that consumed with conventional permanent silica brick furnace linings. In addition the saving in time may be used to effect a greater number of individual heats within a given work period.

The lining of the invention was also evaluated in another trial when the induction furnace was used for the melting of steel from ambient to 1630° C. and gave correspondingly satisfactory results.

Furthermore induction furnaces may be used to melt a greater variety of metals and, particularly, when it is found desirable to use a chemically basic lined vessel at short notice such a lining may be prepared with a minimum of cost, effort and time. A further benefit to the molten metal producer relates to the aspect that cleaner metal can be obtained, which can be illustrated by the metal containing fewer deleterious non-metallic inclusions than metal produced in conventional permanent refractory lined induction furnaces. A still further benefit may be derived from the fact that contamination of a subsequent melt by a previous use can be avoided. To avoid such contamination using a conventional refractory lined furnace involves the use of a furnace specifically retained for a particular metal quality or necessitates that one must reline a furnace with a fresh refractory lining each time it is used to melt metals whenever freedom from contamination is important. These difficulties and the not inconsiderable expense involved can be overcome by the use of inner, discardable linings of the invention.

I claim:

1. An induction furnace comprising an outer casing constructed of one or more panels of refractory ceramic material, and an inner discardable lining, formed from at least one preformed shape of refractory, heat-insulating material comprising 80 to 95 percent particulate refractory filler material and having a density of 1.1 to 1.8 $g.cm^{-3}$ and having low material and installation costs compared to a permanent refractory brick lining or cast monolithic refractory lining.

2. A furnace according to claim 1 in which the inner discardable lining is formed from a plurality of abutting or interfitting lining sections.

3. A furnace according to claim 1 in which the inner discardable lining comprises 80 to 95% by weight of a particulate refractory filler material.

4. A furnace according to claim 1 in which the inner discardable lining has a density of 1.1 to 1.8 $g.cm^{-3}$.

5. A furnace according to claim 1 in which the thickness of the inner discardable lining is from 15 to 50 mm.

6. A furnace according to claim 1 in which the inner inner discardable lining comprises a first layer of refractory, heat-insulating material and a second layer intimately laminated to the said first layer.

7. A furnace according to claim 6 in which the second layer is more heat-insulating than the first layer.

8. A furnace according to claim 1 in which the inner discardable lining comprises an electrical earth leak detection circuit.

9. An induction furnace comprising an inner lining which is discardable and replaceable after a few separate heats are melted, the inner lining comprising at least one preformed shape of refractory material which has high heat insulation and low heat conductivity compared to alumina refractories, and which has a density of 1.1 to 1.8 $g.cm^{-3}$.

10. A furnace according to claim 9 in which the inner discardable lining is formed from a plurality of abutting or interfitting lining sections.

11. A furnace according to claim 9 in which the inner discardable lining comprises 80 to 95% by weight of a particulate refractory filler material.

12. A furnace according to claim 9 in which the thickness of the inner discardable lining is from 15 to 50 mm.

13. A furnace according to claim 9 in which the inner inner discardable lining comprises a first layer of refractory, heat-insulating material and a second layer intimately laminated to the said first layer.

14. A furnace according to claim 13 in which the second layer is more heat-insulating than the first layer.

15. A furnace according to claim 9 in which the inner discardable lining comprises an electrical earth leak detection circuit.

16. A method of maintaining an induction furnace having an inner discardable lining formed from at least one preformed shape of refractory, heat-insulating material and having a density of 1.1 to 1.8 $g.cm^{-3}$ comprising the step of, after a few separate heats, removing the at least one preformed shape of refractory, heat-insulating material comprising the discardable lining, and discarding it, and replacing it with another at least one preformed shape of refractory, heat-insulating material.

17. A method as recited in claim 16 wherein a plurality of preformed shapes form the lining, and wherein the new lining is replaced by the step consisting of abutting or interfitting the slabs.

18. A furnace as recited in claim 1 wherein said heat-insulating refractory material of the inner lining comprises a refractory material which has high heat-insulation and low heat conductivity with respect to alumin refractories.

* * * * *